United States Patent [19]

Erdmann et al.

[11] Patent Number: 4,471,866

[45] Date of Patent: Sep. 18, 1984

[54] APPARATUS OF ASSEMBLING ARRAYS OF CIGARETTES IN PACKING MACHINES

[75] Inventors: Otto Erdmann, Hamburg; Samutt Bamrungbhuet, Reinbek, both of Fed. Rep. of Germany

[73] Assignee: Hauni-Werke Körber & Co. KG., Hamburg, Fed. Rep. of Germany

[21] Appl. No.: 421,561

[22] Filed: Sep. 22, 1982

[30] Foreign Application Priority Data

Apr. 30, 1982 [DE] Fed. Rep. of Germany ..... 3216061

[51] Int. Cl.[3] ..... B65G 47/26

[52] U.S. Cl. ..... 198/419; 198/456; 53/150; 414/62

[58] Field of Search ..... 198/419–421, 198/456, 457; 414/30, 32, 41, 54, 59, 62, 63; 131/282, 283; 53/148–151, 444, 534

[56] References Cited

U.S. PATENT DOCUMENTS

| | | | |
|---|---|---|---|
| 3,435,940 | 4/1969 | Seragnoli | 198/419 |
| 3,520,394 | 7/1970 | Seragnoli | 198/419 |
| 4,341,298 | 7/1982 | Dingli | 198/419 |
| 4,362,235 | 12/1982 | Erdmann | 198/419 |

*Primary Examiner*—Joseph E. Valenza

*Attorney, Agent, or Firm*—Peter K. Kontler

[57] ABSTRACT

The magazine for parallel cigarettes in a packing machine has several groups of ducts each of which serves to accumulate successive layers of cigarettes at different levels so that the layer which is formed in the first group is disposed at a level below the layer formed in the second group, and so forth. A conveyor advances stepwise along the groups of ducts and has open-ended receptacles for layers which are transferred from the groups of ducts during each period of dwell of the conveyor by an intermittently actuated transfer unit. The conveyor is flanked by two stationary guide members whose undersides have sections disposed at different levels and staggered with reference to one another, as considered at right angles to the direction of travel of the conveyor. The guide members further have end faces against which the ends of cigarettes abut during travel from a preceding toward the next-following group of ducts. The sections of the undersides of the guide members overlie the respective end portions of the cigarettes during travel of corresponding receptacles between successive groups of ducts and while the receptacles are held in positions of register with such groups. The sections of the undersides of the guide members prevent the cigarettes in the lower layer or layers from shifting their positions owing to abrupt acceleration during the initial stage of movement from a preceding to the next-following group as well as owing to abrupt deceleration preparatory to movement into register with the next-following group of ducts. The fully assembled arrays of cigarettes in filled receptacles are converted into parallelepiped blocks at a station which follows the last group of ducts.

15 Claims, 10 Drawing Figures

APPARATUS OF ASSEMBLING ARRAYS OF CIGARETTES IN PACKING MACHINES

BACKGROUND OF THE INVENTION

The present invention relates to improvements in apparatus for accumulating arrays of rod-shaped articles, especially for accumulating cigarettes, cigars or cigarillos into arrays which resemble parallelepiped blocks and are ready for introduction into packets or analogous containers. More particularly, the invention relates to improvements in apparatus which can be utilized with advantage in packing machines for cigarettes or analogous rod-shaped articles (hereinafter called cigarettes for short) as a means to transfer from the ducts of a magazine discrete layers of cigarettes for introduction into packets or into hollow receptacles preparatory to the making of envelopes around successively filled receptacles or preparatory to the transfer of arrays from such receptacles into prefabricated packets or into the hollow mandrels of a turret or an analogous conveyor.

It is already known to accumulate multi-layer arrays of cigarettes by resorting to a magazine with several groups of ducts wherein each group of ducts serves to accumulate a succession of layers of parallel cigarettes. Reference may be had to commonly owned patent application Ser. No. 188,255 filed Sept. 19, 1980 by Otto Erdmann, now U.S. Pat. No. 4,362,235 granted Dec. 7, 1982. For the sake of convenience, the disclosure of this patent is incorporated herein by reference. The apparatus of Erdmann utilizes a magazine with three groups of ducts which form successive layers of cigarettes at three different levels, and such layers are thereupon transferred into successive receptacles of an intermittently advancing conveyor which moves successive receptacles to positions of register with successive groups of ducts. Pushers or analogous transfer devices are used to expel the lowermost layers of cigarettes from the corresponding groups of ducts and into the registering receptacles so that each receptacle which advances beyond the last group of ducts contains three superimposed layers of cigarettes, normally in the customary quincunx formation including a lowermost layer of seven parallel cigarettes, a median layer of six parallel cigarettes which are staggered with reference to the cigarettes of the lowermost layer, and an uppermost layer of seven parallel cigarettes which are staggered with reference to the cigarettes of the median layer.

The apparatus of Erdmann further employs stationary guides which confine the cigarettes of successive layers during transfer into the registering receptacles. The guides are disposed at different levels so that they engage the respective layers from above during expulsion of the layers from the respective groups of ducts and into the adjacent receptacles of the intermittently advancing conveyor. The difference between the levels of the guides cooperating with successive groups of ducts equals or approximates the diameter of a cigarette.

An advantage of apparatus wherein arrays of, for example, twenty cigarettes each are formed in several stages (i.e., wherein each array is assembled of discrete layers rather than by simultaneous expulsion of an entire multi-layer array from the magazine of a packing machine) is that the assembly of arrays from discrete layers which are introduced into a receptacle during successive periods of dwell of the conveyor takes up much less time than the accumulation of complete multi-layer arrays in and the transfer of complete arrays from the magazine. The savings in time are attributable to the fact that the accumulation of a layer of cigarettes by gravity takes up but a small fraction of time which is required to accumulate by gravity flow a full multi-layer array of cigarettes. Savings in time are especially desirable in modern high-speed cigarette packing machines each of which can consume the output of at least one cigarette maker or filter tipping machine.

However, heretofore known apparatus which accumulate arrays of cigarettes by assembling such arrays at the rate of one layer at a time also exhibit a serious drawback. Thus, the cigarettes which are disposed in the receptacles of and are moved sideways by the intermittently advancing conveyor are subjected to pronounced acceleration and deceleration tending to move the cigarettes from optimum positions with reference to each other. This is particularly felt in a modern packing machine which must accumulate several hundred multi-layer arrays per minute. While such rapid stepwise advances of the conveyor need not appreciably influence the positions of cigarettes in the fully assembled arrays, abrupt acceleration and deceleration of receptacles which are only partially filled with cigarettes is highly likely to result in at least some undesirable changes in orientation of cigarettes which together constitute less than a full array, i.e., which do not as yet completely fill the respective receptacle. Such changes in orientation can prevent the admission of the last layer of cigarettes and necessitate an interruption of operation with attendant huge losses in output.

OBJECTS AND SUMMARY OF THE INVENTION

An object of the invention is to provide an apparatus which can accumulate discrete layers of cigarettes or analogous rod-shaped articles into arrays consisting of two or more layers and which is constructed and assembled in such a way that abrupt sidewise movements of cigarettes forming less than a full array are not likely to effect undesirable changes in orientation of such articles.

Another object of the invention is to provide a novel and improved method of assembling discrete layers of cigarettes or the like into arrays of superimposed layers at a rate at least matching the maximum permissible rate in heretofore known apparatus but without risking any misalignment of cigarettes in partially assembled arrays.

A further object of the invention is to provide the apparatus with novel and improved means for guiding the articles of partially assembled multi-layer arrays during sidewise transport to thus prevent uncontrolled and undesirable shifting of such articles relative to each other and with reference to their receptacles.

An additional object of the invention is to provide the apparatus with novel and improved means for retaining the orientation of articles in individual layers of partially accumulated arrays during transport of such layers from the magazine of a packing machine to the next processing station.

Still another object of the invention is to provide an apparatus which can be utilized in existing cigarette packing or like machines as a superior substitute for heretofore known apparatus.

A further object of the invention is to provide an apparatus which exhibits the aforediscussed features and whose space requirements do not exceed those of heretofore known apparatus.

A further object of the invention is to provide the apparatus with novel and improved means for positively but gently retaining the articles of individual layers in optimum positions during sidewise transport of the articles toward the location of addition of the last layer to each of a succession of arrays of such articles in a cigarette packing or like machine.

The invention resides in the provision of an apparatus for assembling multi-layer arrays of parallel cigarettes or analogous rod-shaped articles. The apparatus comprises a magazine having groups of ducts including first and second groups which are respectively arranged to successively accumulate first and second layers of parallel articles at a lower first and a higher second level, an endless conveyor having a plurality of open-ended receptacles arranged to move in a predetermined direction along the groups of ducts and being spaced apart from one another so as to register with the first and thereupon with the second group of ducts during successive intervals of dwell of the conveyor, means for transferring layers from the groups of ducts, lengthwise of the articles and at right angles to the direction of travel of the conveyor, into the registering receptacles during the intervals of dwell of the conveyor so that portions of the layers extend from the respective receptacles whereby the second layers come to rest on the first layers in the respective receptacles (the length of the receptacles, as considered at right angles to the direction of travel of the conveyor, is preferably such that the transferred articles extend beyond both open ends of the respective receptacles), and guide means for the layers. The guide means comprises a guide member having an underside composed of several sections disposed at different levels so that a first section of the underside of the guide member overlies portions of the articles in the first layers at least during transport of receptacles containing the first layers from register with the first into register with the second group of ducts, and that a second section overlies portions of articles of the second layer at least while the respective receptacle is in register with the second group of ducts. The guide means is preferably stationary, and the sections of the underside of the guide member are staggered with reference to one another, as considered at right angles to the direction of travel of the conveyor.

The guide member is further formed with end faces extending in the direction of travel of the conveyor and including a first end face which constitutes an abutment for one end of each article in the first layer which is overlapped by the first section of the underside of the guide member while the respective receptacle is in register with the first group of ducts, and a second end face constituting an abutment for one end of each article in the (second) layer which is overlapped by the second section of the underside while the respective receptacle registers with the second group of ducts. The end faces of the guide member are staggered with reference to one another, as considered at right angles to the direction of travel of the conveyor.

The transferring means preferably comprises a discrete layer-transferring portion (e.g., a flat prong or pusher) for each group of ducts, and such portions of the transferring means have article-engaging ends which are staggered with reference to one another, as considered at right angles to the direction of travel of the conveyor, preferably to the same extent as the end faces of the guide member.

The conveyor can be disposed between the magazine and the guide member, and the guide means can comprise a second guide member which is disposed between the magazine and the conveyor and whose underside has several sections disposed at different levels and including a first section overlying the articles of transferred first layers at least while the respective receptacles register with the first group of ducts and while such articles are transported toward the second group of ducts, and a second section which overlies the articles of transferred second layers at least while the respective receptacles register with the second group of ducts.

The sections of the underside of the first mentioned and/or second guide member are preferably formed with inlet portions which flare upwardly toward the magazine to facilitate the advancement of articles therealong while the articles move at right angles to the direction of travel of the conveyor, i.e., during expulsion of layers from the respective groups of ducts.

The apparatus preferably further comprises an aligning or block-building station which is disposed downstream of the groups of ducts, as considered in the direction of travel of the conveyor, and includes means for aligning the articles of arrays in successive receptacles during periods of dwell of the conveyor so that the articles of each array leaving the aligning station constitute a parallelepiped block which is ready for draping into one or more blanks about to be converted into envelopes of packs for cigarettes, cigars, cigarillos or analogous rod-shaped smokers' products. The aligning means can include a stationary portion forming part of the guide means, preferably of that guide member which is outwardly adjacent to the conveyor (adjacent to that side of the conveyor which faces away from the magazine). The aligning means further comprises a mobile portion, and such mobile portion can constitute a component part of the transferring means.

That guide member which is disposed between the magazine and the conveyor is preferably formed with channels for the passage of layers of articles therethrough and into the receptacles which register with the respective groups of ducts. The sections of the underside of such guide member can constitute the top boundaries of the respective channels.

The magazine can include a third group of ducts which is disposed downstream of the second group, and the underside of the guide member is then formed with a third section overlying the articles in the (third) layer which is transferred from the third group of ducts into the receptacle in register with such third group. The second section of the underside of the guide member then preferably extends between the second and third groups of ducts. In such apparatus, the first and second groups of ducts are preferably designed to accumulate layers containing different numbers of articles (e.g., the number of articles in each first layer preferably exceeds the number of articles in each second layer). The number of articles in each third layer can match the number of articles in the first layers so that the articles of a fully assembled array can be disposed in so-called quincunx formations by the simple expedient of staggering the articles of the second layer with reference to the articles of the other layers, as considered in the direction of travel of the conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
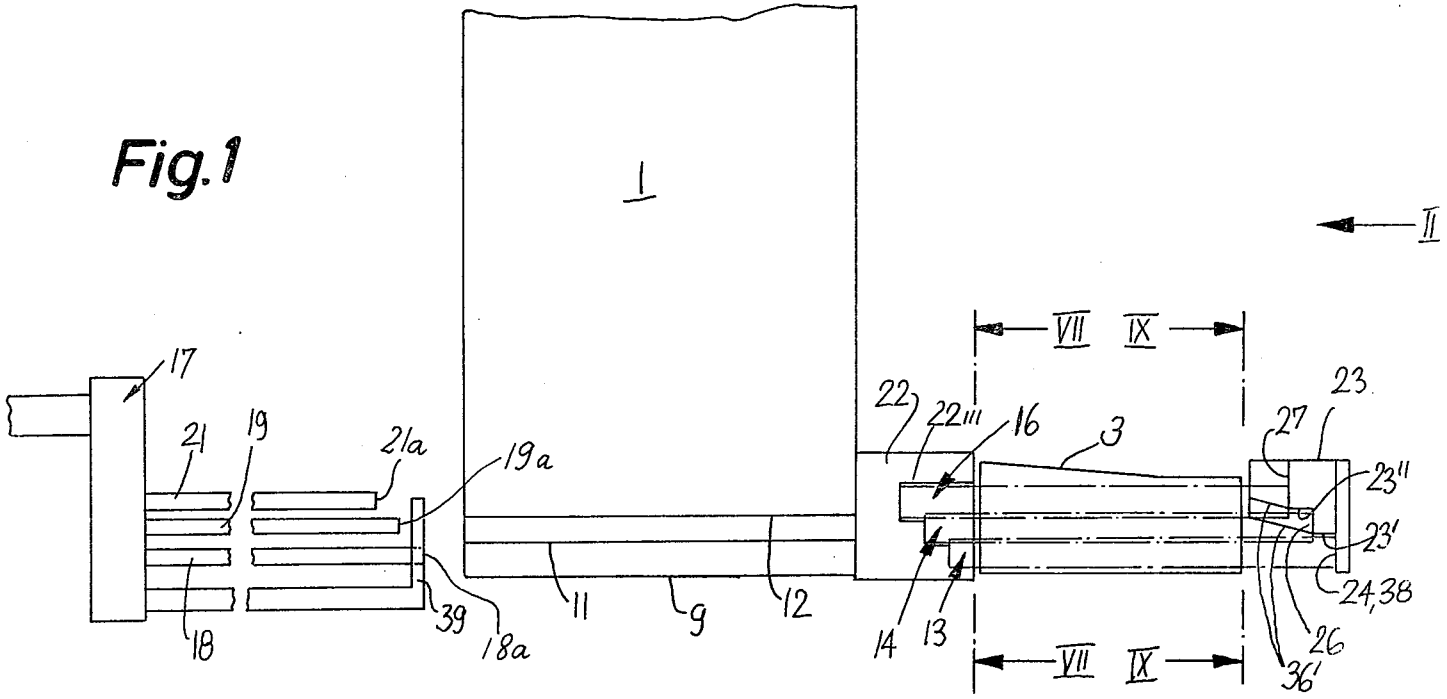
FIG. 1 is a somewhat schematic end elevational view of a portion of an apparatus which serves to accumulate arrays each consisting of three superimposed layers of cigarettes, substantially as seen in the direction of arrow I in FIG. 2.
Figure 2:
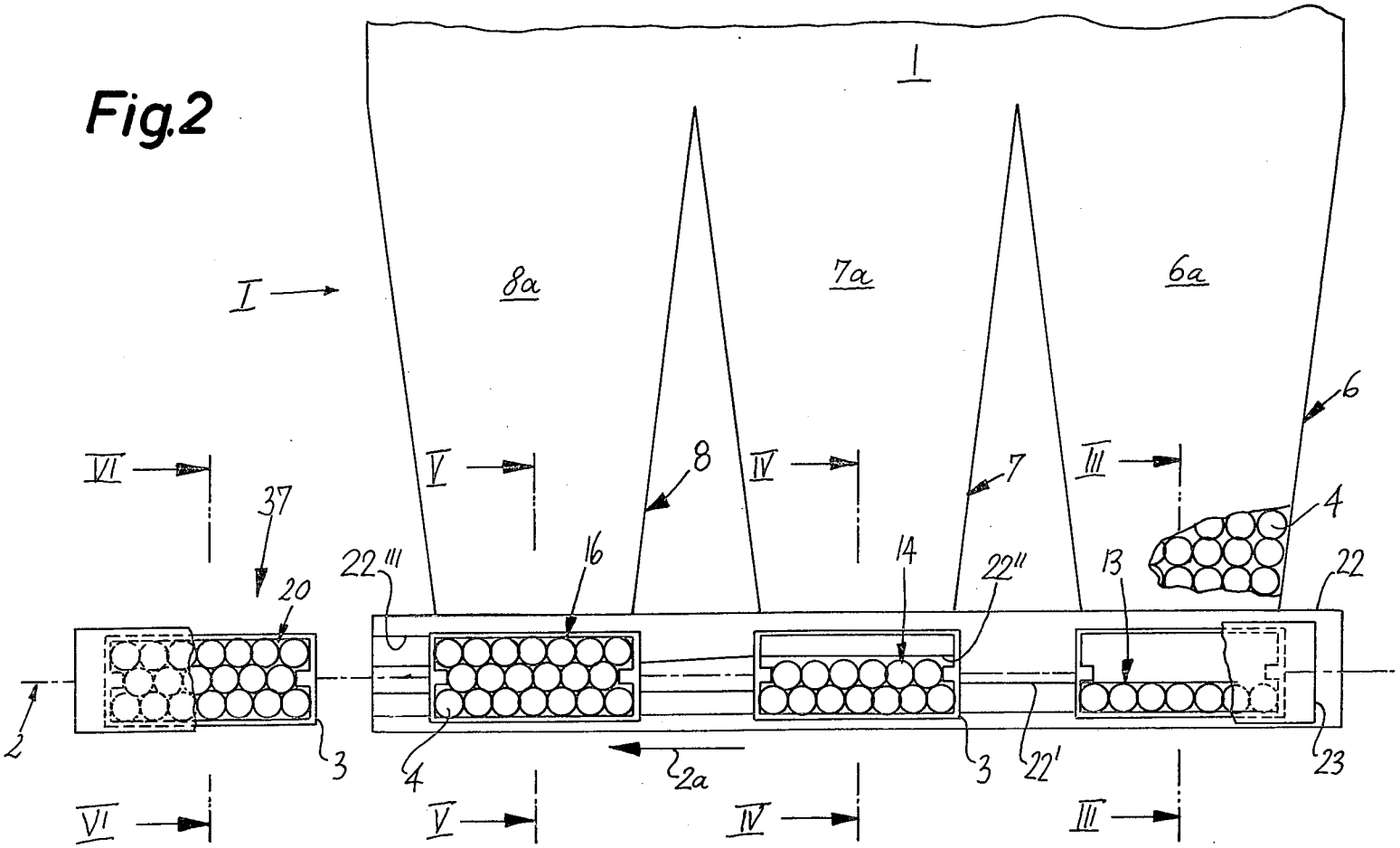
FIG. 2 is a front elevational view of the apparatus substantially as seen in the direction of arrow II in FIG. 1.
Figure 4:
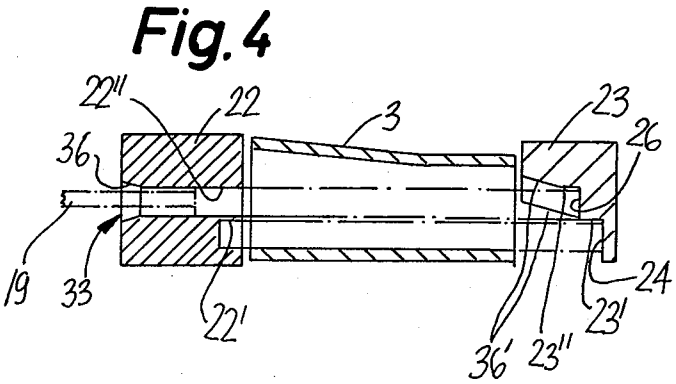
FIG. 4 is a fragmentary transverse vertical sectional view as seen in the direction of arrows from the line IV—IV of FIG. 2.

The apparatus which is shown in FIGS. 1 and 2 comprises a magazine 1, an endless conveyor 2 which is driven stepwise to advance in the direction indicated by arrow 2*a* and includes a series of equidistant open-ended receptacles or pockets 3, a first stationary guide member 22 which is interposed between the front side of the magazine 1 and the conveyor 2, a second stationary guide member 23 which is disposed in front of the conveyor 2, and a transferring unit 17 which, among other functions, serves to expel discrete layers 13, 14, 16 of cigarettes 4 from the magazine 1 whenever it performs a working stroke, namely, a stroke in a direction to the right, as viewed in FIG. 1. The exact details of the conveyor 2 (especially as concerns the means for coupling the neighboring receptacles 3 to each other) form no part of the invention. For example, the conveyor 2 may be an endless chain conveyor of the type shown at 11 in commonly owned U.S. Pat. No. 3,735,767 granted May 29, 1973 to Kruse et al. The magazine 1 may be of the type disclosed in the aforementioned commonly owned allowed application Ser. No. 188,255 filed Sept. 19, 1980 by Otto Erdmann. The disclosure of each patent mentioned herein is incorporated by reference.

The magazine 1 comprises three groups of downwardly extending ducts including a first group 6 which contains seven neighboring ducts for cigarettes 4, a second group 7 which contains six neighboring ducts, and a third group which contains seven neighboring ducts. The apparatus which is shown in the drawing is designed to assemble multi-layer arrays 20 each of which contains twenty parallel cigarettes 4 in the customary quincunx formation. The lowermost layer 13 (as viewed in the drawing) of a fully assembled array 20 contains seven cigarettes 4, the median layer 14 contains six cigarettes which are staggered with reference to the cigarettes in the respective layer 13, and the uppermost layer 16 contains seven cigarettes which are staggered with reference to the cigarettes of the median layer 14.

As can be seen in FIG. 1, the bottom wall 9 of the group 6 of ducts is disposed at a level below the bottom wall 11 of the median group 7 of ducts, and the bottom wall 12 of the group 8 is disposed at a level above the bottom wall 11. The differences between such levels equal or approximate the diameter of a cigarette 4. The bottom walls 9, 11 and 12 are respectively disposed below elongated horizontal slots in the front walls 6*a*, 7*a*, 8*a* of the groups 6, 7 and 8 to permit expulsion of the layers 13, 14, 16 from the corresponding groups of ducts in response to each forward movement of the transferring unit 17. The slots in the front walls 6*a*, 7*a*, 8*a* register with slots in the rear walls of the respective groups of ducts, and such slots in the rear walls permit entry of the corresponding layer-transferring portions or prongs 18, 19 and 21 of the unit 17 when the latter performs a forward stroke whereby the article-engaging front ends 18*a*, 19*a*, 21*a* of the prongs expel layers of cigarettes 4 from the corresponding groups of ducts. When the unit 17 is retracted to the rear end position of FIG. 1, the cigarettes 4 in the groups of ducts are free to descend by gravity whereby the bottom walls 9, 11 and 12 respectively receive fresh layers 13, 14 and 16 which are ready to be expelled from the corresponding groups of ducts in response to next forward movement of the unit 17. The length of the prongs 18, 19 and 21 suffices to ensure that the ends 18*a*, 19*a*, 21*a* of these prongs introduce the corresponding layers 13, 14, 16 all the way into the receptacles 3 which happen to register with the outlet slots of the corresponding groups 6, 7, 8 while the unit 17 performs a forward stroke. The spacing between neighboring receptacles 3 matches that between the neighboring groups of ducts, and the conveyor 2 is driven intermittently by steps whose length matches the distance between the centers of two neighboring receptacles 3 so that a fresh receptacle registers with the outlet slot of each of the groups 6, 7, 8 in response to each stepwise advance of the conveyor 2.

The length of each of the receptacles 3 (as considered at right angles to the direction of movement of the conveyor 2) is less than the length of a cigarette 4 (see FIGS. 3 to 7), and each receptacle 3 is open at both ends, namely, at the end facing the magazine 1 as well as at the other end which faces away from the magazine and toward the guide member 23.

In accordance with a feature of the invention, the apparatus further comprises the aforementioned first guide member 22 which is disposed between the front side of the magazine 1 and that reach of the conveyor 2 which is adjacent to but spaced from the magazine, and the aforementioned second guide member 23 disposed in front of the just mentioned reach of the conveyor 2. In other words, the guide members 22 and 23 flank that portion of the conveyor 2 which is adjacent to the front side of the magazine 1. The guide member 22 has a composite underside consisting of sections 22′, 22″, 22‴ which are staggered in the direction of arrow 2a and the sections 22''' and 22'' respectively overlap in part the sections 22'' and 22' (note particularly FIGS. 7 and 8). The sections 22', 22'', 22''' respectively overlie the layers 13, 14, 16 during transfer of such layers into the receptacles 3 and thereupon during the immediately following steps of such receptacles. The sections 22', 22'' and 22''' are disposed at different levels (note particularly FIG. 2) which are spaced apart from one another by distances corresponding to or approximating the diameter of a cigarette 4.

The second guide 23 is also formed with a composite underside including two sections 23' and 23''. The section 23' overlies successive layers 13 after entry of such layers into the respective receptacles 3 in front of the group 6, during transport of such receptacles toward positions of register with the group 7, during transfer of layers 14 from the ducts of the group 7, during transport of receptacles 3 from positions of register with the outlet slot in the front wall 7a toward positions of register with the outlet slot in the front wall 8, and during introduction of the layers 16. The section 23'' overlaps the front end portions of cigarettes 4 in a layer 14 during introduction of such layer, during transport of the layer 14 from the group 7 to the group 8, and during introduction of the corresponding layer 16. It will be seen that the sections 22' to 22''' guide the trailing portions of cigarettes in the respective layers 13, 14, 16 in the space between the front side of the magazine 1 and the pockets 3, and that the sections 23', 23'' overlie the front end portions of cigarettes 4 in the respective layers in the regions where such layers extend beyond the corresponding receptacles 3.

The guide member 23 is further formed with vertical rear end faces 24, 26, 27 each of which makes a right angle with the sections 23', 23'' and which respectively serve as abutments for the front end faces of cigarettes 4 in the layers 13, 14 and 16. The end faces 24, 26, 27 are staggered with reference to each other, as considered at right angles to the direction of travel of the conveyor 2, to the same extent as the ends 18a, 19a, 21a of the prongs 18, 19, 21. The guide member 22 is formed with transversely extending front end faces 28, 29 and 31 constituting abutments for the rear ends of the cigarettes 4 in the respective layers 13, 14 and 16. Such rear end faces extend transversely of the sections 22', 22'' and 22'''.

The first guide member 22 is further formed with horizontal channels or slots 32, 33 and 34 which are respectively disposed at levels below the sections 22', 22'' and 22''' and serve for the passage of corresponding layers 13, 14, 16 through the guide member 22 and into the adjacent receptacles 3. The inlet portions 36 of the channels 32, 33 and 34 taper rearwardly and outwardly, namely, toward the front side of the magazine 1, to thereby ensure unimpeded entry of and to prevent damage to the front ends of the cigarettes 4 in the respective layers during advancement of such layers through the guide member 22. Analogously, the inlet portions 36' of the sections 23' and 23'' taper rearwardly and upwardly for the same purpose, i.e., to permit unobstructed advancement of the front end portions of cigarettes 4 in the respective layers 13 and 14 into abutment with the end faces 24 and 26. The front ends of the uppermost layers 16 of cigarettes abut against the end face 27 of the second guide member 23 when such cigarettes are properly received in the respective receptacles 3.

Successive receptacles 3 which contain fully assembled arrays 20 move into register with a stationary aligning portion 38 at an aligning or block-forming station 37 located downstream of the magazine 1, as considered in the direction of arrow 2a. The aligning portion 38 forms part of the guide member 23. The transferring unit 17 comprises a mobile aligning portion 39 which moves toward the rear ends of cigarettes 4 in a fully assembled array 20 at the station 37 when the unit 17 performs a working stroke whereby all cigarettes in the array 20 are moved into abutment with the stationary aligning portion 38 to thus ensure that the front end faces of such cigarettes are located in a first common plane and the rear end faces of such cigarettes are located in a second common plane parallel to the first common plane, i.e., each array 20 is converted into a parallelepiped block.

The mode of operation is as follows:

The magazine 1 contains a substantial supply of parallel cigarettes 4 which descend by gravity in the ducts in each of the groups 6, 7 and 8 so that, when the transferring unit 17 is held in the retracted position of FIG. 1, a layer 13 of seven cigarettes 4 rests on the bottom wall 9 of the group 6, a layer 14 of six cigarettes 4 rests on the bottom wall 11 of the group 7, and a layer 16 of seven cigarettes 4 rests on the bottom wall 12 of the group 8. The ducts in the groups 6, 7 and 8 taper downwardly toward the respective bottom walls 9, 11 and 12 to thus ensure that the cigarettes 4 resting on such bottom walls are parallel to and close to one another. The layer 13 on the bottom wall 9 of the group 6 is in line with the front and rear slots of the corresponding portion of the magazine 1. As mentioned above, the front slot is located in the front wall or panel 6a of the group 6 and the rear slot is in reigster with the prong 19 of the unit 17. Analogously, the layer 14 on the bottom wall 11 is in register with the slot in the front wall or panel 7a as well as with the slot in the rear wall of the group 7, i.e., in register with the prong 19 of the unit 17. The layer 16 on the bottom wall 12 is in register with the slot in the front wall or panel 8a as well as with the slot which registers with the prong 21 of the unit 17. The width of the slots in the front walls or panels 6a, 7a, 8a and the widths of the spaces above the bottom walls 9, 11 and 12 are selected in such a way that these bottom walls barely accommodate the respective layers 13, 14 and 16 (i.e., the cigarettes 4 of such layers are close to and parallel with one another) and that properly formed layers 13, 14 and 16 can pass through the slots in the respective front panels 6a, 7a, 8a. As mentioned above, each of the layers 13, 16 contains seven closely adjacent parallel cigarettes 4, and each layer 14 contains six closely adjacent parallel cigarettes 4. This is due to the fact that the illustrated apparatus is designed to accumulate arrays 20 each of which contains twenty parallel cigarettes 4 in the customary formation. It goes without saying that the apparatus can be readily modified to accumulate arrays each of which contains more than three layers or only two layers, as well as that the number of cigarettes in the individual layers need not match those in the layers 13, 14 and 16.

FIG. 2 shows that, during each period of dwell of the conveyor 2, a discrete receptacle 3 is held in a position of register with the slot in each of the three front panels 6a, 7a and 8a. The transferring unit 17 then performs a forward stroke in response to actuation of a suitable motor (not specifically shown) so that the prongs 18, 19 and 21 respectively enter the spaces above the corresponding bottom walls 9, 11 and 12 to expel the corresponding layers 13, 14 and 16 into the registering receptacles 3. The layers 13, 14 and 16 which are being transferred into the corresponding receptacles 3 are disposed at different levels. The front end portions of the cigarettes 4 in the freshly transferred layer 13 thereby come to rest at a level below the section 23' of the underside of the second guide member 23 and into abutment with the end face 24, the front end portions of cigarettes 4 in the freshly transferred layer 14 come to rest below the secton 23" of the second guide member 23 and into abutment with the end face 26, and the front ends of cigarettes in the freshly transferred layer 16 come into contact with the rear end face 27 of the guide member 23 but are not overlapped by the underside of the guide 23. At the same time, the rear end portions of cigarettes 4 in the freshly transferred layer 13 are located below the section 22' of the underside of the first guide member 22, the rear portions of cigarettes 4 in the freshly transferred layer 14 are located below the section 22" of the guide member 22, and the rear portions of cigarettes 4 in the freshly transferred layer 16 are located below the section 22''' of the guide member 22. The sections 22', 22", 22''', 23' and 23" extend in the direction of movement of the conveyor 2 so that each of the layers 13, 14, 16 is guided at least while the conveyor 2 performs one step in the direction of the arrow *2a*.

Figure 6:
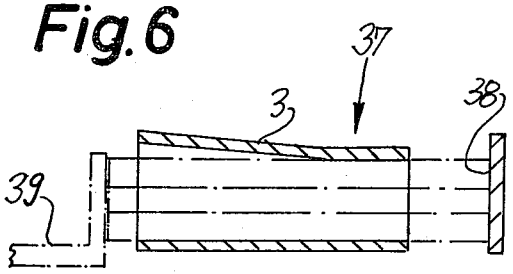
FIG. 6 is a transverse vertical sectional view as seen in the direction of arrows from the line VI—VI of FIG. 2.
Figure 3:
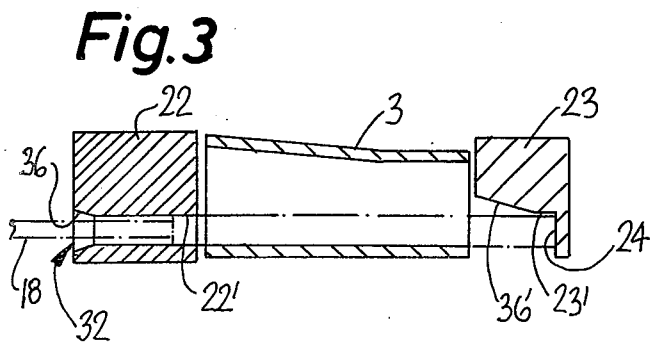
FIG. 3 is a fragmentary transverse vertical sectional view as seen in the direction of arrows from the line III—III of FIG. 2.
Figure 5:
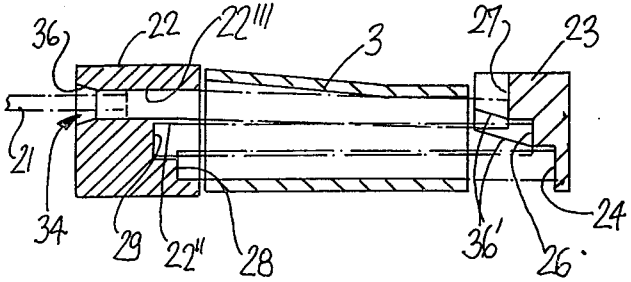
FIG. 5 is a fragmentary transverse vertical sectional view as seen in the direction of arrows from the line V—V of FIG. 2.
Figures 7, 8, 9, 10:
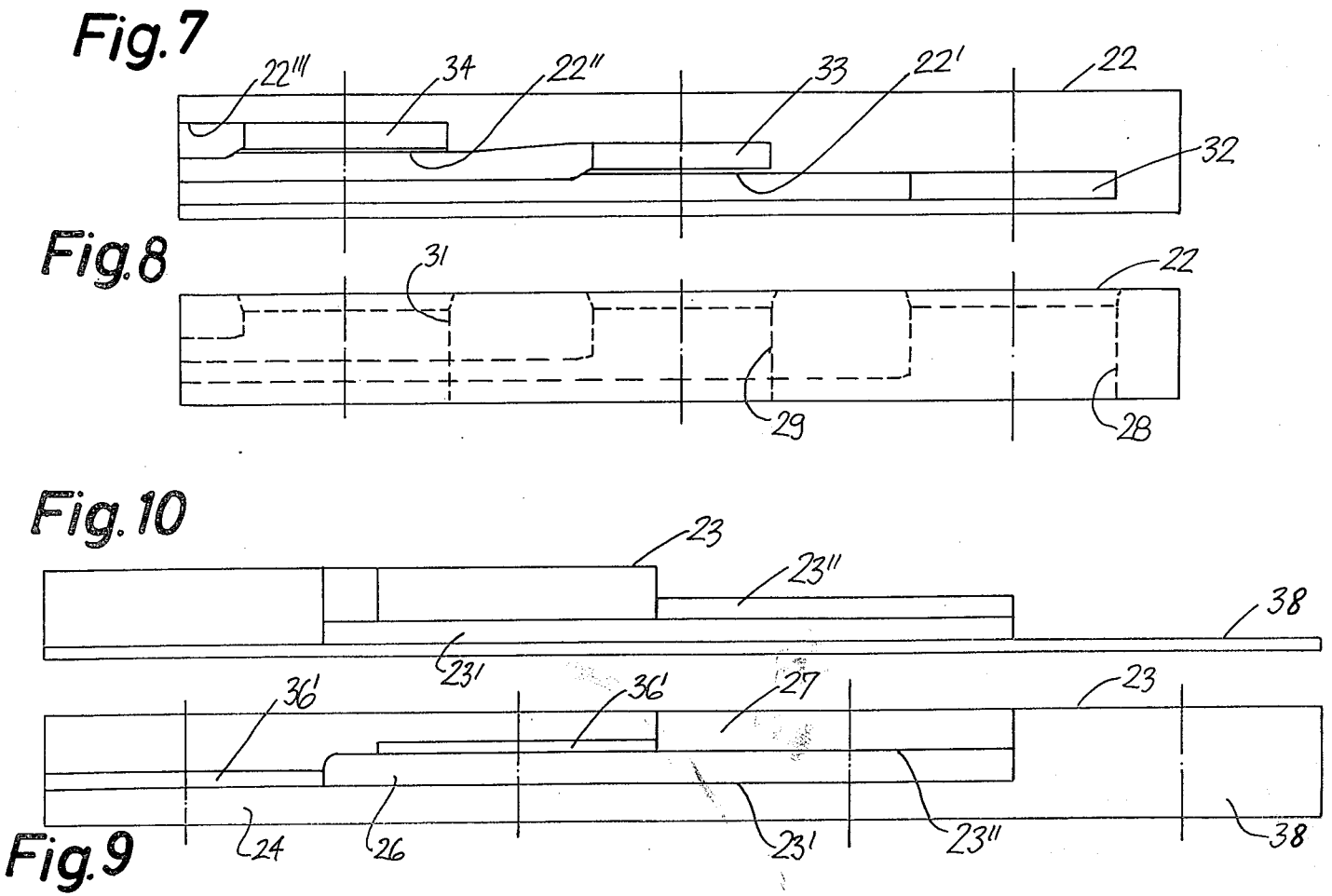
FIG. 7 is a side elevational view of one of the guide members substantially as seen in the direction of arrows from the line VII—VII of FIG. 1.
FIG. 8 is a plan view of the guide member which is shown in FIG. 7.
FIG. 9 is a side elevational view of the second guide member, substantially as seen in the direction of arrows from the line IX—IX of FIG. 1.
FIG. 10 is a bottom plan view of the guide member which is shown in FIG. 9.

An inspection of FIGS. 5, 6 and 7 will reveal that the sections 22' and 22" respectively extend to the groups 7 and 8 to thereupon disappear so as not to interfere with the admission of layers 14 at the station accommodating the group 7 and/or with the admission of layers 16 at the layer-forming station accommodating the group 8. In other words, the layers 14 which are expelled from the group 7 at the central layer-forming station of FIG. 2 can come to rest on the respective layers 13 (already in the corresponding receptacles 3), and the layers 16 can come to rest on top of the corresponding layers 14 in the respective receptacles 3. The sections which overlie the layers 14 at the layer-forming station including the group 7 provide room for settling of cigarettes 4 forming such layers between the cigarettes 4 of the respective lowermost layers 13 to thus ensure the establishment of the aforementioned quincunx formations. There is no need for the provision of a third section at the underside of the second guide member 23 (such as would correspond to the section 22''' of the underside of the guide member 22) because the upper sides of the cigarettes 4 in the layers 16 are guided by the undersides of the top walls of the corresponding receptacles 3.

The receptacles 3 which advance beyond the group 8 contain fully assembled arrays 20 of twenty cigarettes 4 each, and such receptacles come to rest, seriatim, at the aligning station 37 where the mobile aligning portion 39 of the unit 17 moves all of the cigarettes 4 in the respective array 20 against the stationary aligning portion 38 of the guide member 23 so that the front end faces of all twenty cigarettes are located in a first common plane and the rear end faces of all twenty cigarettes are located in a second common plane parallel to the first common plane.

The receptacles 3 thereupon advance beyond the aligning station 37 and are relieved of their contents at a further station where the arrays 20 are transferred into packs or into mandrels which are used for the building of packs therearound in a manner not forming part of the present invention. Reference may be had to the aforementioned U.S. Pat. No. 3,735,767, to commonly owned U.S. Pat. No. 3,750,676 granted Aug. 7, 1973 to Kruse et al., and/or to commonly owned U.S. Pat. No. 3,956,870 granted May 18, 1976 to Kruse et al.

An important advantage of staggered sections 22'–22''' and 23'–23''', as well as of staggered end faces 24, 26, 27 and 28, 29, 31, is that the lower layers 13, 14 can be properly guided and held in preselected axial positions during sidewise transport of the respective cigarettes 4 in the direction of arrow *2a*. Such guidance of the tops of end portions of cigarettes 4, as well as of the end faces of the cigarettes, prevents any undesirable changes of orientation prior to introduction of the topmost layers 16 into the respective receptacles 3. It has been found that the improved apparatus ensures predictable accumulation of short or long series of identical arrays 20, even if the receptacles 3 undergo highly pronounced acceleration and deceleration between successive intervals of dwell of the conveyor 2. Axial staggering of cigarettes 4 in the arrays arriving from the group 8 of ducts is eliminated automatically as soon as such arrays reach the aligning station 37. In the absence of axial staggering of cigarettes 4 forming the layers 13 (in the receptacles 3) with reference to the cigarettes of the corresponding layers 14, the cigarettes of the layers 13 could not move along the section 23' of the underside of the guide member 23. The same holds true for the section 23" and the corresponding end portions of cigarettes 4 in the layers 14.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for assembling multi-layer arrays of parallel cigarettes or analogous rod-shaped articles, comprising a magazine having groups of ducts including first and second groups respectively arranged to successively accumulate first and second layers of parallel articles at a lower first and a higher second level; a conveyor having a plurality of receptacles arranged to move in a predetermined direction along said groups and being spaced apart from one another so as to register with said first and thereupon with said second group during successive intervals of dwell of said conveyor; means for transferring layers from said groups, lengthwise of the articles and at right angles to said direction, into the registering receptacles during the intervals of dwell of said conveyor so that portions of the layers extend from the respective receptacles and the second layers come to rest on the first layers in the respective receptacles; and guide means for said layers, including a guide member having an underside comprising sections disposed at different levels so that a first section overlies portions of articles in the first layers, at least during transport from said first to said second group, and that a second section overlies portions of articles of the second layers at least while the respective receptacles are in register with said second group, said sections being staggered with reference to one another as considered at right angles to said direction.

2. The apparatus of claim 1, wherein said guide member is stationary.

3. The apparatus of claim 1, wherein said guide member has end faces extending in said direction and including a first end face constituting an abutment for one end of each article in the first layer which is overlapped by said first section and a second end face constituting an abutment for one end of each article in the layer which is overlapped by said second section, said end faces being staggered with reference to one another as considered at right angles to said direction.

4. The apparatus of claim 3, wherein said transferring means comprises a layer-transferring portion for each of said groups and such portions of said transferring means have article-engaging ends which are staggered with reference to one another as considered at right angles to said direction.

5. The apparatus of claim 4, wherein the extent to which the ends of said portions of said transferring means are staggered with reference to each other matches the extent to which said end faces of said guide member are staggered relative to one another.

6. The apparatus of claim 1, wherein said conveyor is disposed between said guide member and said groups, said guide means further comprising a second guide member disposed between said groups and said conveyor and having an underside including several sections disposed at different levels and including a first section overlying the articles of transferred first layers, at least while the respective receptacles register with said first group and are transported toward said second group, and a second section which overlies the articles of transferred second layers at least while the respective receptacles register with said second group.

7. The apparatus of claim 1, wherein said sections of the underside of said guide member have inlet portions flaring upwardly and toward the magazine to facilitate the advancement of articles therealong at right angles to said direction.

8. The apparatus of claim 1, further comprising an aligning station provided downstream of said groups, as considered in said direction, and including means for aligning the articles of the arrays in successive receptacles during periods of dwell of said conveyor so that the articles of each array leaving said station constitute a parallelepiped block.

9. The apparatus of claim 8, wherein said locating means includes a stationary portion forming part of said guide means.

10. The apparatus of claim 9, wherein said conveyor is disposed between said magazine and said guide member and said stationary portion of said locating means forms part of said guide member.

11. The apparatus of claim 8, wherein said aligning means comprises a mobile portion forming part of said transferring means.

12. The apparatus of claim 1, wherein said guide member is disposed between said magazine and said conveyor and includes channels for the passage of layers therethrough and into the receptacles registering with the respective groups.

13. The apparatus of claim 12, wherein said sections of said underside constitute the top boundaries of the respective channels.

14. The apparatus of claim 1, wherein said magazine includes a third group of ducts disposed downstream of said second group and said underside has a third section overlying the articles of the layer which is transferred from the third group into the receptacle in register with such third group, said second section extending between said second and third groups, as considered in said direction.

15. The apparatus of claim 1, wherein said first and second groups are arranged to accumulate successive first and second layers wherein the number of articles in the first layers deviates from the number of articles in the second layers.

* * * * *